US005283131A

United States Patent [19]

Mori et al.

[11] Patent Number: 5,283,131

[45] Date of Patent: Feb. 1, 1994

[54] ZINC-PLATED METALLIC MATERIAL

[75] Inventors: Kazuhiko Mori; Shinji Nomura, both of Kanagawa, Japan

[73] Assignee: Nihon Parkerizing Co., Ltd., Tokyo, Japan

[21] Appl. No.: 827,400

[22] Filed: Jan. 29, 1992

[30] Foreign Application Priority Data

Jan. 31, 1991 [JP] Japan ..... 3-29017
Jan. 31, 1991 [JP] Japan ..... 3-29018

[51] Int. Cl.[5] ..... B32B 15/04; C25D 5/10

[52] U.S. Cl. ..... 428/623; 428/632; 428/633; 428/658; 428/659; 205/316; 205/319

[58] Field of Search ..... 428/613, 658, 659, 935, 428/623, 633, 632; 148/262; 205/316, 319

[56] References Cited

U.S. PATENT DOCUMENTS 4,904,544 2/1990 Mori et al. ..... 428/658

FOREIGN PATENT DOCUMENTS 59-17164 5/1984 Japan ..... 428/659
59-05264 6/1984 Japan ..... 428/659
60-125395 7/1985 Japan .
60-141898 7/1985 Japan .
02-254178 10/1990 Japan .

*Primary Examiner*—Benjamin R. Fuller
*Assistant Examiner*—Valerie Ann Lund
*Attorney, Agent, or Firm*—Armstrong, Westerman, Hattori, McLeland & Naughton

[57] ABSTRACT

A zinc-plated metallic material resistant to corrosion at elevated temperatures comprising a metallic material; a plating layer consisting of zinc or zinc alloy containing 70% by weight or more of zinc; and a coating layer on the plating layer comprising 10 to 5,000 mg. of magnesium oxide or hydrated magnesium oxide and 50 to 5,000 mg. of chromium oxide or hydrated chromium oxide per square meter of the coating layer.

1 Claim, No Drawings

ZINC-PLATED METALLIC MATERIAL

BACKGROUND OF INVENTION

1. Field of Invention

The present invention is related to a zinc-plated metallic material, more particularly to a corrosion-resistant coating applied on a metallic material which has improved corrosion-resistance after heating. Mainly, the coating according to the present invention is applied on a steel sheet and comprises mainly Zn.

2. Description of Related Arts

The ordinary rust-proofing method of steel materials is Zn plating. It is required particularly in the Zn-plated steels used in automobiles to enhance the heat-resistance of the Zn plating.

Japanese Unexamined Patent Publication No. 60-141898 discloses a composite zinc plating, in which oxides of Al, Ti, Si and the like are dispersed so as to enhance the a corrosion resistance. The composite components used in this Zn coating are, however, chemically stable oxides and hence exhibit merely a physical protecting function. The corrosion resistance of this coating is therefore unsatisfactory.

Therefore the use of a compound having a chemically inhibiting function as the composite component has been tried, to attain satisfactory corrosion-prevention with a small amount of addition.

Such composite plating is disclosed, for example, in Japanese Unexamined Patent Publication No. 60-125395 and consists of zinc and a soluble aluminum oxide, whose $Al^{3+}$ ions realizes the inhibiting function and attains an improved corrosion-resistance under such an environment where the aluminum oxide is dissolved.

Many automobile parts are exposed under a high-temperature condition due to heat emitted from the engine and the gas-exhausting system. The post-heating corrosion-resistance is, therefore, required for such parts. However, in the provision of the conventional composite zinc plating, no consideration has been made regarding this point in the conventional composite zinc plating, that is, to the deterioration in corrosion-resistance which follows heating. Even in the case of acid-soluble aluminum oxide dispersed in the Zn plating layer, crystallization of the Al compound proceeds due to heating and is converted to an insoluble form, thereby deteriorating the corrosion-resistance.

When the Zn-plated steel sheet is used in such a manner that the Zn plating layer is exposed, zinc oxide, which is rust of zinc, readily forms. This rust is referred to as white rust. The Zn-plated steel sheet is, therefore, conventionally subjected to chromating so as to prevent the formation of white rust. The chromating method consists of dipping a steel sheet in an aqueous solution containing hexavalent chromium. Various chromate coatings, such as lustrous, yellow and green coatings are formed which, however, have low heat-resistance. When these coatings are heated to a temperature of approximately 80° C. or more, such defects, as cracking, peeling and the like, are formed on the chromate coating, with the result that the corrosion resistance is drastically lowered.

For the reasons as described above, the corrosion-resistance of the chromate coating is insufficient for using a chromated material for the parts used in the engine room of an automobile. Another problem of chromate coating lies in its appearance due to color, such as yellow or interference color of hexavalent chromium. A countermeasure against this problem is to reduce the deposition amount of chromium to such a level that a virtually colorless coating is formed. This countermeasure, however, causes another problem in that the corrosion-resistance of the chromate coating is reduced.

SUMMARY OF INVENTION

It is, therefore, an object of the present invention to provide a corrosion-resistant composite zinc-plated metallic material, having good appearance and improved corrosion-resistance which is not deteriorated after heating.

It is, therefore, another object of the present invention to provide a corrosion-resistant composite zinc-plated and chromated metallic material having improved corrosion-resistance which is not deteriorated after heating.

The present inventors discovered that magnesium compounds among various compounds have high corrosion-resistance, whose performance is not deteriorated due to heating. Such properties of the magnesium compounds are not seen in other compounds.

The present inventors also discovered the following regarding the magnesium compounds.

(1) Only the magnesium compound which is soluble in hydrochloric acid at a concentration of approximately 0.01N or more achieves an outstandingly high effect when it is contained in the zinc plating as a composite component.

(2) A layer of magnesium oxide or magnesium hydrated oxide formed on the zinc plating layer also achieves an outstandingly high effect.

(3) When a chromium oxide or chromium hydrated oxide is contained in the layer according to (2), the effects are further enhanced.

In accordance with the discovery (1), there is provided a composite zinc-plated metallic material comprising: a metallic material; a plating layer which consists of zinc or zinc alloy and from 0.01 to 50% of magnesium compound in terms of magnesium, which compound is soluble in 0.01N hydrochloric acid solution.

In accordance with the discovery (2), there is provided a zinc-plated metallic material comprising: a metallic material; a plating layer which consists of zinc or zinc alloy containing 70% or more of zinc; and a coating of at least one of magnesium oxide or magnesium hydrated oxide in an amount of from 10 to 5000 $mg/m^2$ in terms of magnesium.

In accordance with the discovery (3), there is provided a zinc-plated metallic material comprising: a metallic material; a plating layer which consists of zinc or zinc alloy containing 70% or more of zinc; a layer of at least one of magnesium oxide or magnesium hydrated oxide in an amount of from 10 to 5000 $mg/m^2$ in terms of magnesium; and a layer of at least one of chromium oxide or chromium hydrated oxide in an amount of from 10 to 5000 $mg/m^2$ in terms of magnesium.

The present invention is hereinafter described in detail.

The magnesium compounds, which are soluble in 0.01N hydrochloric acid solution, are magnesium hydroxide, magnesium chloride, magnesium sulfate, basic magnesium chloride, magnesium phosphate, magnesium pyrophosphate, and magnesium silicate. Although these are representative compounds which are soluble in acid, the magnesium compounds used in the present invention are not limited thereto, provided that the magnesium compound, including an organic compound, is soluble in acid and the magnesium of the compound is ionized. Spinel, i.e., magnesium-aluminum oxide, is such a magnesium compound which is insoluble in acid and hence cannot be used in the present invention. Magnesium oxide, which is dried or calcined at a low temperature, is soluble in 0.01N hydrochloric acid solution and is hence usable in the present invention, while magnesium oxide, which is calcined for a long time at a high temperature, is difficult to dissolve in 0.01N hydrochloric acid solution and is hence not usable in the present invention.

Magnesium content of the zinc composite coating in the range of from 0.01 to 50% is necessary for attaining a satisfactory corrosion-resistance. A preferable magnesium content is from 0.1 to 20%.

The base metal of the composite coating is zinc or a zinc alloy which mainly consists of zinc and contains alloying element(s) such as Ni, Fe, Co and Sn. Since the corrosion-prevention effect of Mg for protecting Zn is outstanding as compared with protection property of other metals, the base metal must be Zn.

The zinc-plated metallic material provided based on the discovery (2) is now described.

The metallic material is plated with zinc, zinc-alloy or zinc composite material, so that the plating layer has a Zn content of 70% or more. The representative metals are steel, cast iron or stainless steel. The zinc alloy plating is represented by zinc-nickel alloy, zinc-iron alloy, or zinc-tin alloy. The composite zinc plating is represented by a plating with a composite component consisting of such compound as alumina, silica or chromium oxide. Shape of the metallic material is not limited.

The zinc content is not less than 70% and not more than 100%, the balance being additive alloying element(s), composite compound, and impurities, because the corrosion-prevention property of magnesium (hydrated) oxide is largely dependent on and is sensitive to the material to be corrosion-protected. When the thickness of the zinc plating layer is very thin, the corrosion-prevention effect is unsatisfactory. On the other hand, when the thickness of the zinc plating layer is very thick, it is not economical. A preferable thickness, which is between these limits and is advantageous, is from 1 to 30 $\mu$m.

Magnesium oxide or magnesium hydrated oxide in an amount of from 10 to 5000 mg/m$^2$ is deposited on the zinc coating layer. A preferable deposition amount in terms of magnesium is from 50 to 1000 mg/m$^2$ from the viewpoints of corrosion-resistance and adhesion of the coating. If further improvement of the property is desired, chromium oxide or chromium hydrated oxide in an amount of from 5 to 2000 mg/m$^2$ is deposited on the zinc coating layer, in addition to the magnesium (hydrated) oxide. A preferable deposition amount in terms of chromium is from 10 to 500 mg/m$^2$ from the viewpoints of corrosion-resistance and adhesion of the coating. When a colorless coating is required, the deposition amount of the coating in terms of chromium is desirably from 10 to 200 mg/m$^2$. The reasons for limiting the deposition amount of magnesium and chromium compounds to 10 to 5000 mg/m$^2$ in terms of Mg and from 5 to 2000 mg/m$^2$ in terms of Cr are that the corrosion-resistance is virtually not at all improved and hence the coating is impractical at a deposition amount less than the lower limits, while the adhesion of the coating on the substrate metal is impaired and the coating is liable to peel at a deposition amount exceeding the upper limits. The chromium compound coating may be a separate layer from the magnesium compound coating. The former coating may be formed over or under the latter coating. The chromium compound and magnesium compound may be co-present in a monolithic layer.

There are a number of methods for preparing the composite coating of zinc (alloy) and magnesium compound are hereinafter described.

The impregnating method is first described. A porous zinc or zinc-alloy plating, in which a number of minute pores are present, is first described. A solution containing a magnesium compound, such as magnesium chloride, magnesium nitrate, or magnesium phosphate is impregnated into the pores, dried and then heated. The porous plating described above can easily be prepared by cathodic electrolysis in the bath containing zinc chloride and zinc nitrate. In addition, the porous layer can be prepared by mixing zinc powder with an appropriate binder and applying the mixture on a metal sheet. Furthermore, the porous layer can be physically prepared by subjecting a steel sheet to barrel finishing or shot blasting with the use zinc-plated balls. The acidic solution applied on the porous surface reacts with zinc in the zinc plating coating, with the result that pH rises and the soluble magnesium compound precipitates in the zinc plating layer.

The dispersion plating method is next described. The fine particles of a magnesium compound are dispersed in the zinc-plating bath, and the electro-plating is carried out while stirring the plating bath.

The kind of magnesium compounds, which are insoluble in water or acid, is limited, and is for example magnesium hydroxide, magnesium phosphate and or magnesium silicate. These magnesium compounds can be incorporated in alkaline zinc plating bath and can be deposited in the plating layer from such bath.

Furthermore, good composite coating is obtained by dissolving magnesium phosphate and magnesium pyrophosphate in an acidic zinc plating bath, adding an oxidizing agent, such as nitric acid, nitrous acid, bromic acid or the like into the acidic zinc plating bath, and electrolyse in the bath to form a composite zinc-magnesium compound plating layer. The composite zinc plating layer can also be formed by hot-dip galvanizing and vapor-deposition.

The composite zinc plating as described above is applied mainly on the surface of steels and exhibits improved corrosion-resistance even after it is heated to a high temperature in the range of from 300° to 400° C. because of its inhibiting function as described below. This inhibiting function can be explained as follows. When the magnesium ions and zinc are copresent at the corrosion of the zinc, the magnesium hydroxide or magnesium carbonate, which have high electric insulating property, is formed and suppresses the corrosion-current. Such metal ions as aluminum and chromium ions also exhibit an inhibiting function to suppress the corrosion of the zinc but are converted due to heating to an insoluble form or difficult-to-dissolve form. Such insoluble or difficult-to-dissolve magnesium compound does not ionize during corrosion of the zinc plating layer and hence cannot attain a satisfactory corrosion. The magnesium compound, which is soluble in 0.01N hydrochloric acid, maintains acid-solubility even after heating. When the magnesium compound is exposed to a severe corrosion condition containing brine, the magnesium compound dissolves to yield $Mg^+$ ions which exhibit effective corrosion-prevention function. Magnesium ionizes presumably because Zn dissolves to yield $Zn^{2+}$ ions and behaves as an anode and hydrochloric acid is formed by a corrosion-reaction to provide pH approximately 2–3, with the result that magnesium dissolves under such pH. The requirement that the magnesium compound is soluble in 0.01N hydrochloric acid is necessary for effectively realizing the corrosion-prevention function.

A method for forming a coating of magnesium (hydrated) oxide is now described. This coating is easily formed on a zinc plating layer by a coating method or by cathodic electrolysis. A solution containing a magnesium compound is applied on the zinc plating layer and is heated to a temperature of from 200° to 300° C. so as to thermally decompose the same to yield a coating of magnesium oxide. Appropriate solutions are those containing magnesium chloride, magnesium nitrate and magnesium carbonate.

Similar thermal decomposition method to the one described above may be used to prepare a zinc-plated metallic material, on which both chromium compound and magnesium compound are present. The solution, which is applied on the zinc-plated metallic material and then subjected to the thermal decomposition, contains, in addition to the magnesium compound, trivalent chromium compound. Appropriate chromium compounds are trivalent chromium nitrate, trivalent chromium chloride and trivalent chromium sulfate. The deposition amounts of magnesium and chromium can be freely adjusted by amounts of magnesium and chromium can be freely adjusted by changing the concentration of metal ions in the coating liquid.

Cathodic electrolysis is another appropriate method for forming a coating of magnesium (hydrated) oxide.

According to this method, the plating bath is an aqueous solution which contains magnesium ions and such depolarizer ions as nitric acid, nitrous acid, bromic acid and iodic acid. The electrolysis is carried out in the plating bath while using the zinc-plated metallic material as the cathode. The magnesium ions are deposited on the surface of the zinc plating layer in the form of hydroxide and/or hydrated oxide to form a coating. This hydrated oxide is used for the coating according to the present invention as is. The hydrated oxide may be heated to a temperature between the room temperature and 120° C. so as to dehydrate the same to yield oxide, which is used as the coating. The hydroxide may be likewise heated to yield the hydrated oxide or oxide, which is used as the coating. These methods are advantageous in the point that heating at high temperature such as roll-on coating method, is unnecessary, and uniform deposition amount is attained even in the case of forming a coating on the shaped articles.

In the cathodic electrolysis method, the magnesium ions and trivalent chromium ions may be added to the plating liquid, so as to deposit on the zinc plating layer a coating, in which the magnesium and chromium hydrated oxides are mixed.

The coating of chromium oxide may be formed by the chromating method. Although the disadvantages of the chromate coating can be reduced by the magnesium compound, this method is less desirable than the other methods for forming the chromium-oxide coating, because such disadvantages cannot be completely eliminated. In addition, since the hexavalent chromium, which is indispensable to the chromating method, must be treated by a waste-liquid control system, the roll-on coating methods and the cathodic electrolysis method, in which no such treatment is necessary, are preferable.

The magnesium compound, which is deposited on the surface of the zinc-plated metallic material, improves its heat-resistance and corrosion-resistance for the following reasons. The magnesium (hydrated) oxide has so high electric insulating property that the flow of the corrosion current, which is generated during the corrosion of the zinc plating layer, is suppressed. The magnesium (hydrated) oxide prevents the permeation of oxygen so that the zinc plating layer is corrosion-protected from the oxygen. The conventional chromating coating also has such protecting function, which is therefore not peculiar to the magnesium. However, when such protecting functions of the chromate coating and magnesium are compared with regard to the post-heating property to a temperature of from 100° to 300° C., cracks appear in the chromate coating which partly peels, so that such defects act as the starting point of corrosion. Once cracking or peeling occurs, the advance of corrosion is accelerated and the protection function lessens drastically. Contrary to this, since the corrosion-resistance of the magnesium compound is maintained even after heating, the magnesium compound present on the surface of zinc plating layer clearly provides excellent post-heating protecting function as compared with the chromate coating. When the magnesium compound on the surface of zinc plating layer corrodes, the magnesium compound is anodized or dissolved anodically, while acid, which is formed as a result of the corrosion reaction, dissolves the magnesium compound, with the result that a magnesium solution is formed and covers, at the initial period of corrosion, the plating surface. This means that any defect in the zinc plating layer formed as a result of corrosion, is remedied by the magnesium compound.

The above described properties of the magnesium compound, i.e., easy solubility in acid, and the non-deterioration of this property after heating, contribute to effective protecting function at high temperature. It believed that the chromate coating virtually does not have this property, because its solubility in acid is low.

When both magnesium and chromium compounds are deposited on the surface of a zinc plating layer, the corrosion-resistance is better than the coating of magnesium compound only. The reason for this is believed to be the following. The magnesium compound is soluble to some extent in an aqueous medium having pH value close to neutral value while the chromate compound is insoluble in such aqueous medium. Copresence of magnesium and chromium compounds has better resistance against water as compared with the coating consisting only of magnesium compound. Provided that the magnesium and chromium compounds are present in the coating at the amount specified above, the silica and alumina, which is insoluble to the hydrochloric acid, may be present in the coating.

The present invention is described in more detail with reference to the examples.

EXAMPLE 1

In this example, a composite coating was formed on steel sheets (SPCC). The heat- and corrosion-resistance was evaluated by heating the prepared samples in an oven at 300° C. for 20 hours and then subjecting the samples to the salt spray test (JIS Z 2371) for testing the corrosion resistance.

The composite coatings were prepared by the impregnation method and the dispersion plating method described above. Samples Nos. 1 through 5 were prepared by the latter method, and the samples Nos. 6 through 15 were prepared by the former method.

The comparative samples 1-3 and the inventive samples 1 through 5 were prepared by electroplating for 4 minutes at a current density of 5A/dm$^2$ in the zincate bath, which contained from 200 g/l of caustic soda and 20 g/l of zinc oxide, and further contained the respective, additive dispersing magnesium compound powder of a particle diameter of from 0.05 to 5 μm given in Table 1.

The inventive samples 6 through 14 were prepared by electroplating for 4 minutes at a current density of 5A/dm$^2$ in a zinc plating bath, which contained 60 g/l of zinc chloride and 0.7 g/l of zinc nitrate, and whose pH was adjusted to 2.5. As a result of plating, a porous zinc plating layer was formed. The so-treated workpieces were immersed in a solution which contained the respective magnesium compound so as to impregnate the pores with the magnesium compound, followed by drying.

The inventive samples 15 through 25 were prepared by electroplating for 4 minutes at a current density of 5A/dm$^2$ in a zinc plating bath, which contained 60 g/l of zinc chloride, 50 g/l of nickel chloride and 0.7 g/l of zinc nitrate, and whose pH was adjusted to 2.5. As a result of plating, a porous zinc-nickel alloy plating layer was formed. The so-treated workpieces were immersed in a solution which contained the respective magnesium compound so as to impregnate the pores with the magnesium compound, followed by drying.

The drying was carried out in an oven at 110° C. for 10 minutes with regard to the samples 6 through 8 and 200° C. for 20 minutes with regard to the samples 15 through 17. The heat- and corrosion-resistance was evaluated under the following criterion.

| Evaluating Point | Heat- and Corrosion-Resistance | Time until Generation of Red Rust |
|---|---|---|
| 5 | Excellent | 300 hours or more |
| 4 | Very good | 150-299 hours |
| 3 | Good | 50-149 hours |
| 2 | Fair | 25-49 hours |
| 1 | Poor | 24 hours or less |

The (in)soluble property of the magnesium compounds in the hydrochloric acid is judged by adding 0.1 g of the respective compound into a beaker which contained 100 ml of 0.01N hydrochloric acid, and detecting the solubility after 24 hours by atomic absorption analysis of filtrates.

In Table 1, the solubility are indicated by soluble and insoluble.

TABLE 1

| No. | Magnesium Compound | Mg content (%) in the coating | Heat and Corrosion Resistance | Acid Solubility |
|---|---|---|---|---|
| Comparative 1 | Magnesium hydroxide | 0.005 | 2 | Soluble |
| Comparative 2 | Magnesium oxide | 0.008 | 2 | Soluble |
| Comparative 3 | Spinel ($MgO.Al_2O_3$) | 2.0 | 2 | Insoluble |
| Inventive 1 | Magnesium silicate | 0.15 | 3 | Soluble |
| Inventive 2 | Magnesium hydroxide | 0.5 | 3 | Soluble |
| Inventive 3 | Magnesium hydroxide | 2.0 | 4 | Soluble |
| Inventive 4 | Magnesium oxide (lightly calcined) | 46 | 4 | Soluble |
| Inventive 5 | Magnesium silicate | 21 | 4 | Soluble |
| Inventive 6 | Magnesium chloride | 1.0 | 4 | Soluble |
| Inventive 7 | Magnesium sulfate | 3 | 4 | Soluble |
| Inventive 8 | Magnesium nitrate | 2 | 4 | Soluble |
| Inventive 9 | Basic magnesium chloride | 5.5 | 5 | Soluble |
| Inventive 10 | Magnesium hydroxide | 3 | 4 | Soluble |
| Inventive 11 | Magnesium phosphate | 16 | 5 | Soluble |
| Inventive 12 | Magnesium phosphate | 20 | 5 | Soluble |
| Inventive 13 | Magnesium pyrophosphate | 2.5 | 4 | Soluble |
| Inventive 14 | Magnesium pyrophosphate | 10 | 5 | Soluble |
| Inventive 15 | Magnesium chloride | 1.0 | 4 | Soluble |
| Inventive 16 | Magnesium sulfate | 3 | 5 | Soluble |
| Inventive 17 | Magnesium sulfate | 2 | 4 | Soluble |
| Inventive 18 | Basic magnesium chloride | 5.5 | 5 | Soluble |
| Inventive 19 | Magnesium hydroxide | 3 | 5 | Soluble |
| Inventive 20 | Magnesium phosphate | 16 | 5 | Soluble |
| Inventive 21 | Magnesium phosphate | 20 | 5 | Soluble |
| Inventive 22 | Magnesium pyrophosphate | 2.5 | 5 | Soluble |
| Inventive 23 | Magnesium pyrophosphate | 10 | 5 | Soluble |
| Inventive 24 | Magnesium hydroxide | 2 | 5 | Soluble |
| | Magnesium phosphate | 1 | | Soluble |
| Inventive 25 | Magnesium silicate | 0.5 | 5 | Soluble |
| | Magnesium oxide (lightly burnt) | 2 | | Soluble |

As is clear from the above example, the composite zinc-plating coating according to the present invention has better post-heating corrosion resistance as compared with the comparative examples, in which the magnesium compound is acid-insoluble or the amount of acid-soluble magnesium compound is small. The post-heating corrosion-resistance according to the present invention is improved over that of the conventional zinc-plated coating or the conventional zinc-plated/-chromated coating. The metallic material provided according to the present invention is therefore used in the heat-resistant corrosion-proof applications, where the corrosion-resistant property of the conventional coatings was insufficient, such as the brake of the automobile and parts around an automobile engine, as well as parts of a motorcycle. The metallic material according to the present invention can provide by inexpensive method excellent corrosion-resistance to parts which are not exposed to influence of heat, because the magnesium compound has excellent inhibiting function.

EXAMPLE 2

In this example, a coating of magnesium and chromium compounds (oxide or hydroxide) was formed on the electro-zinc plated steel sheet, electro zinc-nickel alloy plated steel sheet (Ni content-11%), or hot-dip zinc galvanzized steel sheet, which were used as the starting materials. The samples having the coating were prepared. The coating of the magnesium and chromium compounds were formed by the coating method and cathodic electro-deposition method under the following conditions.

In the comparative samples 4 through 7 and the inventive samples 26 through 39, the samples were prepared by the coating method. The aqueous solution was prepared by dissolving the magnesium chloride and chromium chloride in water so as to provide the magnesium and chromium deposition amounts given in Table 2. This solution was uniformly applied on the surface of the steel sheets by a bar coater. The samples, on which the aqueous solution was applied, were heated in an oven at 250° C. for 1 hour.

The comparative samples 8 through 11 and the inventive samples 40 through 53 were prepared by the cathodic electrolysis method. The concentration of magnesium and chromium ions was adjusted within a range of from 50 to 5000 ppm in accordance with target deposition amount. The electrolysis current density was from 0.3 to 2.5A/dm$^2$, and the electrolysis time was from 5 to 600 seconds. In the electrolysis bath for forming each sample, 10 g/l of nitrate ions were added to cause precipitation of Mg or Cr hydrated oxide on the plating surface. Mg and Cr were added in the form of nitrate except for the bath composition where the nitrate ions become excessive. In such a case, magnesium and chromium chlorides were added in the form of chlorides to provide pH 3 and to completely dissolve the chlorides. After the completion of electrolysis, the samples were immediately rinsed with water and dried at 120° C. for 10 minutes.

The heat- and corrosion-resistance was evaluated by the same method as in Example 1, except that the heating time in an oven is 3 hours.

The deposition amount of zinc (alloy) plating was as follows.

1. Zinc-electroplating (20 g/m$^2$)
2. Zinc-nickel electro alloy-plating (20 g/m$^2$)
3. Galvannealed (45 g/m$^2$)

The kinds of zinc plate are denoted by the above numerals in Table 2.

TABLE 2

| No. | Plating | Mg deposition amount (mg/m$^2$) | Cr deposition amount (mg/m$^2$) | Heat- and Corrosion Resistance |
|---|---|---|---|---|
| Inventive | | | | |
| 26 | 1 | 15 | — | 2 |
| 27 | 1 | 150 | — | 3 |
| 28 | 1 | 550 | — | 4 |
| 29 | 1 | 4200 | — | 4 |
| 30 | 1 | 15 | 10 | 3 |
| 31 | 1 | 150 | 50 | 4 |
| 32 | 1 | 550 | 200 | 5 |
| 33 | 1 | 4200 | 1900 | 5 |
| 34 | 2 | 200 | — | 4 |
| 35 | 2 | 300 | 100 | 5 |
| 36 | 2 | 4500 | 1850 | 5 |
| 37 | 3 | 200 | — | 4 |
| 38 | 3 | 300 | 100 | 5 |
| 39 | 3 | 4500 | 1900 | 5 |
| 40 | 1 | 14 | — | 2 |
| 41 | 1 | 156 | — | 3 |
| 42 | 1 | 542 | — | 4 |
| 43 | 1 | 4300 | — | 4 |
| 44 | 1 | 14 | 10 | 3 |
| 45 | 1 | 156 | 50 | 4 |
| 46 | 1 | 542 | 200 | 5 |
| 47 | 1 | 4300 | 1900 | 5 |
| 48 | 2 | 250 | — | 4 |
| 49 | 2 | 300 | 110 | 5 |
| 50 | 2 | 4700 | 1870 | 5 |
| 51 | 3 | 250 | — | 3 |
| 52 | 3 | 300 | 110 | 5 |
| 53 | 3 | 4600 | 1870 | 5 |
| Comparative | | | | |
| 4 | 1 | — | 200 | 1 |
| 5 | 1 | 5 | 3 | 1 |
| 6 | 2 | 5 | 3 | 3 |
| 7 | 3 | 6 | 3 | 2 |
| 8 | 1 | — | 180 | 2 |
| 9 | 1 | 5 | 4 | 1 |
| 10 | 2 | 5 | 3 | 3 |
| 11 | 3 | 6 | 4 | 2 |

As is described above in the examples, the inventive samples exhibit better post-heating corrosion-resistance than the comparative samples.

The inventive coating does not have the drawback of the conventional zinc-plated/chromated metallic material, that is, such drawback as rust arises when it is used for parts which are exposed to influence of heat. The inventive coating has an excellent protecting effect on the underlying material, which does not deteriorate at a high temperature.

We claim:

1. A zinc-plated metallic material comprising a metallic material; a plating layer consisting of zinc or zinc alloy containing 70% by weight or more of zinc; a coating layer on the plating layer comprising at least one of magnesium oxide or hydrated magnesium oxide in an amount of from 10 to 500 mg per square meter of the coating layer and also at least one of chromium oxide or chromium hydrated oxide in an amount of from 10 to 500 mg of chromium per square meter of said coating layer.

* * * * *